US006955443B2

(12) United States Patent
Solowiej

(10) Patent No.: US 6,955,443 B2
(45) Date of Patent: Oct. 18, 2005

(54) LIGHTED WINE AND DRINKING GLASS BASE

(76) Inventor: Henry Edward Solowiej, 1592 Glenwood Way, Upland, CA (US) 91786

( * ) Notice: Subject to any disclaimer, the term of this patent is extended or adjusted under 35 U.S.C. 154(b) by 0 days.

(21) Appl. No.: 10/179,380

(22) Filed: Jun. 26, 2002

(65) Prior Publication Data

US 2004/0001332 A1 Jan. 1, 2004

(51) Int. Cl.[7] ..... F21V 33/00
(52) U.S. Cl. ..... 362/101; 362/155; 362/190
(58) Field of Search ..... 362/101, 109, 362/155, 190, 234, 253, 399, 400, 562, 394, 395, 410, 412, 414; 215/DIG. 7; 220/710.5

(56) References Cited

U.S. PATENT DOCUMENTS

| | | | | | |
|---|---|---|---|---|---|
| 2,224,319 | A | * | 12/1940 | Schroyer | 362/101 |
| 2,532,181 | A | * | 11/1950 | Moore | 362/101 |
| 2,745,947 | A | * | 5/1956 | Sansous | 362/109 |
| 3,735,113 | A | * | 5/1973 | Stott | 362/101 |
| 4,336,574 | A | * | 6/1982 | Goodman | 362/101 |
| 4,563,726 | A | | 1/1986 | Newcomb et al. | |
| 4,922,355 | A | | 5/1990 | Dietz et al. | |
| 5,010,461 | A | * | 4/1991 | Saotome | 362/101 |
| 5,070,435 | A | | 12/1991 | Weller | |
| 5,119,279 | A | | 6/1992 | Makowsky | |
| 5,171,081 | A | | 12/1992 | Pita et al. | |
| 5,211,699 | A | | 5/1993 | Tipton | |
| 5,609,409 | A | * | 3/1997 | Diehl | 362/101 |

* cited by examiner

*Primary Examiner*—Sandra O'Shea
*Assistant Examiner*—Bao Q. Truong
(74) *Attorney, Agent, or Firm*—Vladimir Khiterer

(57) ABSTRACT

A drinking glass base apparatus having a wide base ascending to a narrow top, the under side of the rigid base being hollow and open all the way through the narrow top; a machined lip on the inside of the base to accommodate a partition member; a partition member housing electronic components consisting of a battery holder powered by a battery and activated by an on/off switch supplying energy to an LED. An LED is mounted to point directly up through the top of the narrow portion of the glass base, but extending only a short distance up into the narrow top of the base. A hole at the top of the glass base is machined larger than the hole opening provided for the LED so that the transparent stem of a drinking glass can be inserted and permanently fastened into the top of the narrow base to allow the light from the LED to be projected up into the drinking glass when the switch is turned on. A flat removable membrane material is at the bottom portion of the glass base to conceal the underside of the drinking glass base, and the base will vary in color as will the LED, being one of a number of colored lights.

9 Claims, 7 Drawing Sheets

LIGHTED WINE AND DRINKING GLASS BASE

This invention is a device for emitting light up through the bottom of a stemmed wine or drinking glass.

The apparatus includes a rigid, cone-type, free standing base similar to a common wine glass base yet being more exaggerated and concave in shape so as to provide extra space on the underside of the base. The underside of the glass base is hollow in construction with thin yet rigid walls suitable for strength and utility. At the center horizontal dimension of the cone-type structure is a slight outward circumference lip machined to provide a slight horizontal shelf to accommodate the mounting of a small electronic circuit board. The complete inside of the wine glass base is hollow as well as the shaft opening at the narrow top portion of the base.

A small electronic circuit board is seated securely upon the horizontal shelf of the underside of the rigid base attached by secure mechanical means.

The circuit board consists of various electronic components arranged to permit the light source, i.e., the light emitting diode (LED) to extend upward and directly centered so as to protrude up into the narrow hollow top portion of the base. The LED, which has long rigid electrode leads, are cut off to allow the top point of the LED to sit at a point approximately one inch from the top portion of the base. The interior circumference of the top of the base is machined large enough in dimension to accommodate the insertion of the stem of the glass, crystal, plastic or similar transparent material. Preferably the stem of the glass is attached to the lighted base by suitable fastening methods.

The LED light is activated by a battery which is switched on by a small mechanical switch that is mounted on the circuit board. The battery is mounted in a battery holder which is also attached to the circuit board.

The switch is activated by turning the switch to the on or off position.

At the very lower portion but not at the outermost lower position of the free standing base there are two cylindrically machined hold posts which which are mounted as part of the original base unit. The hollow posts are machined appropriately to accommodate screws for insertion and fastening purposes. The two hollow machined points are provided to accommodate a covering plate to conceal the underworkings of the glass base. Two holes are machined in the covering plate so that the fastening screws will hold the covering plate onto the hollow posts on the underside of the base unit. The rigid cover plate also has a small opening at the precisely designed location to expose the switch lever enabling the off and on operation without removing the cover. The cover plate is attached by the two screws which can easily be removed and reattached when changing the battery.

Another feature of the invention is the option of selecting different colored lighting enabling each person to identify his own glass.

BACKGROUND

This invention is a base to a stemmed drinking glass of the wine or water glass variety, specifically to glasses that have a base which houses a light that when turned on will shine up through the glass stem and illuminate the glass itself.

Often wine, champagne or exotic drinks are consumed during evening hours under dimly lit conditions. A disadvantage to using a tall glass in a dark environment is that it is easy to knock over the glass when reaching for it or some other item on the table.

Additionally, some people with impaired vision might find it easier to use this glass with less chance of spilling their drink.

There is also the safety factor to consider especially on those occasions where glass usage occurs in a pool or spa environment. With fewer broken glasses, overall safety is improved.

And finally, when gathered in a social or party environment, it becomes easy to identify one's own glass when each vessel has a different colored light to distinguish it from others.

Beyond the practical utility of this invention there is an aesthetic beauty of the product an owner will appreciate.

SUMMARY

This device is a base to a stemmed drinking glass which houses a battery operated light that when turned on will shine up through the glass stem and illuminate the glass above and its contents.

DRAWINGS

DESCRIPTION

The invention is a wine glass base which is hollow and has an apparatus inside for a light to be switched on causing a light beam to shine upward into the inserted stem of a wine, champagne or water glass.

Figure 1:
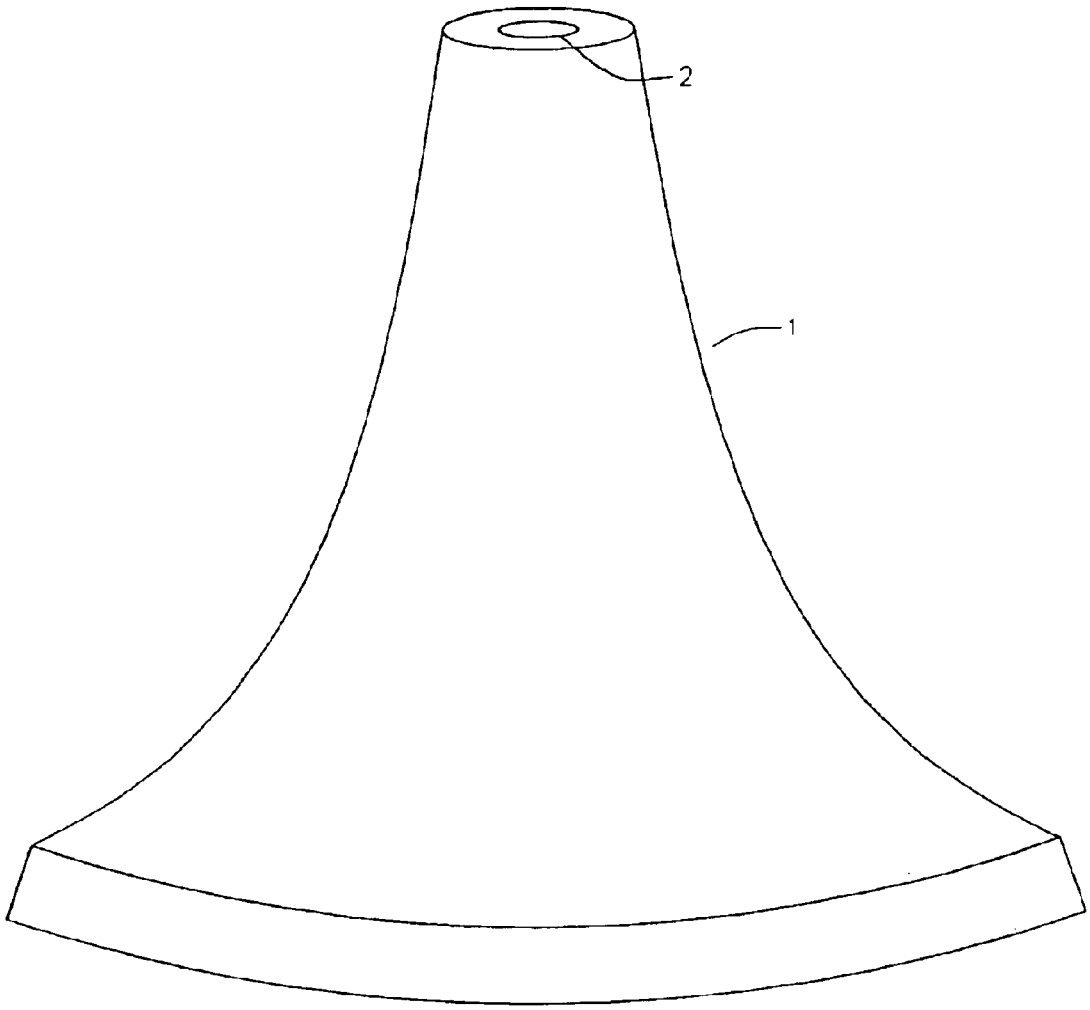
FIG. 1 is an oblique elevation perspective view of a hollow wine glass base.
Figure 2:
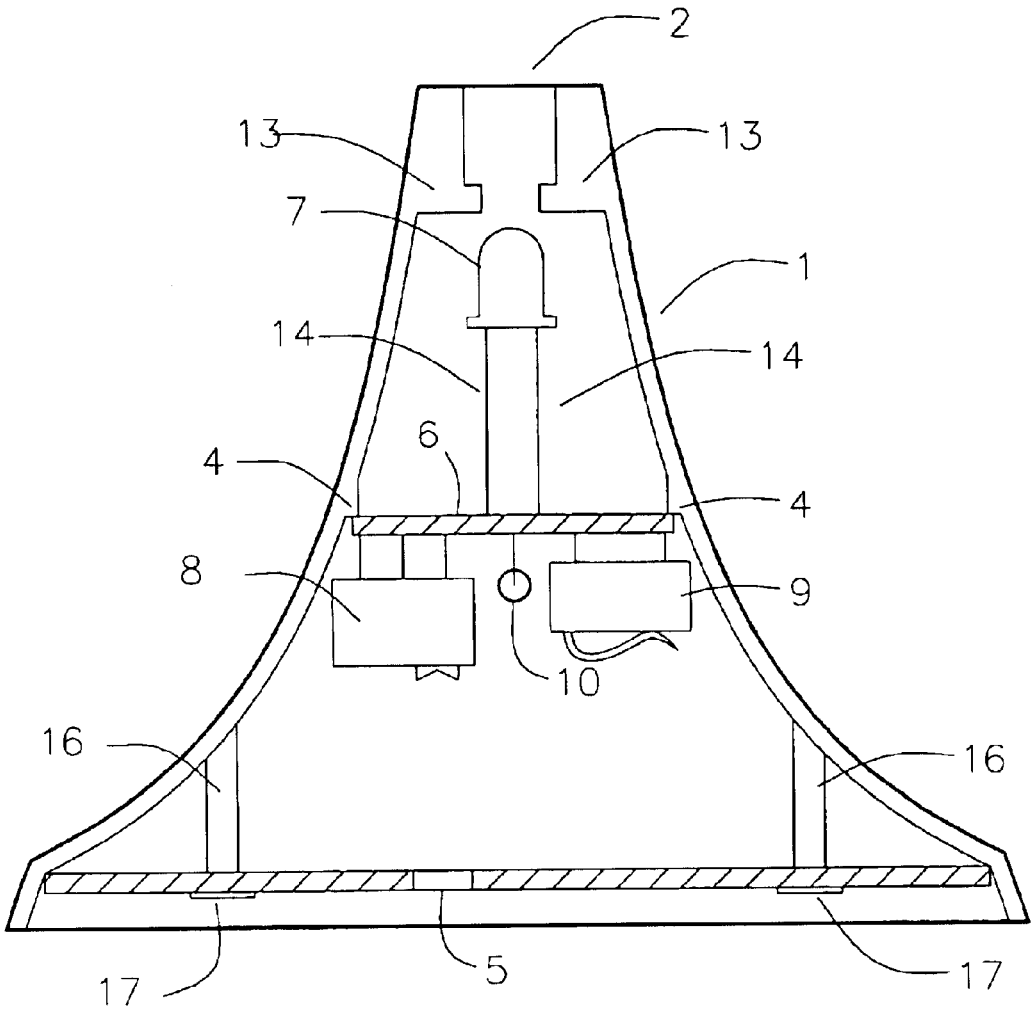
FIG. 2 is a sectional front elevation view of the apparatus of FIG. 1.

As shown in FIG. 1, the shape is very similar to most wine glass bases in that the lower base is size balanced in diameter and rising to a smaller diameter at the top. The top portion of FIG. 1 has a hole 2 machined through the center which is approximately 0.5 to 1.0 inch deep shown in FIG. 2. FIG. 7 shows how the glass stem 11 of the wine glass 12 is inserted into the opening 2 stopping at the machined stem shelf 13. FIG. 2 shows the sectional side of the base 1 which can be made of brass, plastic, acrylic or other rigid material, and a machined or molded shelf 4 which houses the circuit board 6. The LED 7 is extended up towards the smaller machined hole 3. FIG. 2 shows how the circuit board 6 has the LED soldered by the legs 14 on the top side of the circuit board 6. The switch 8 and battery holder 9 and resister 10 are mounted to the lower section of the board 6. The lower portion of the switch 8 is mounted so that it can be easily turned on or off through the hole 5 in the covering membrane 15 of FIG. 6.

FIG. 2 shows the battery holder 9 is also mounted on the circuit board 6.

Figure 3:
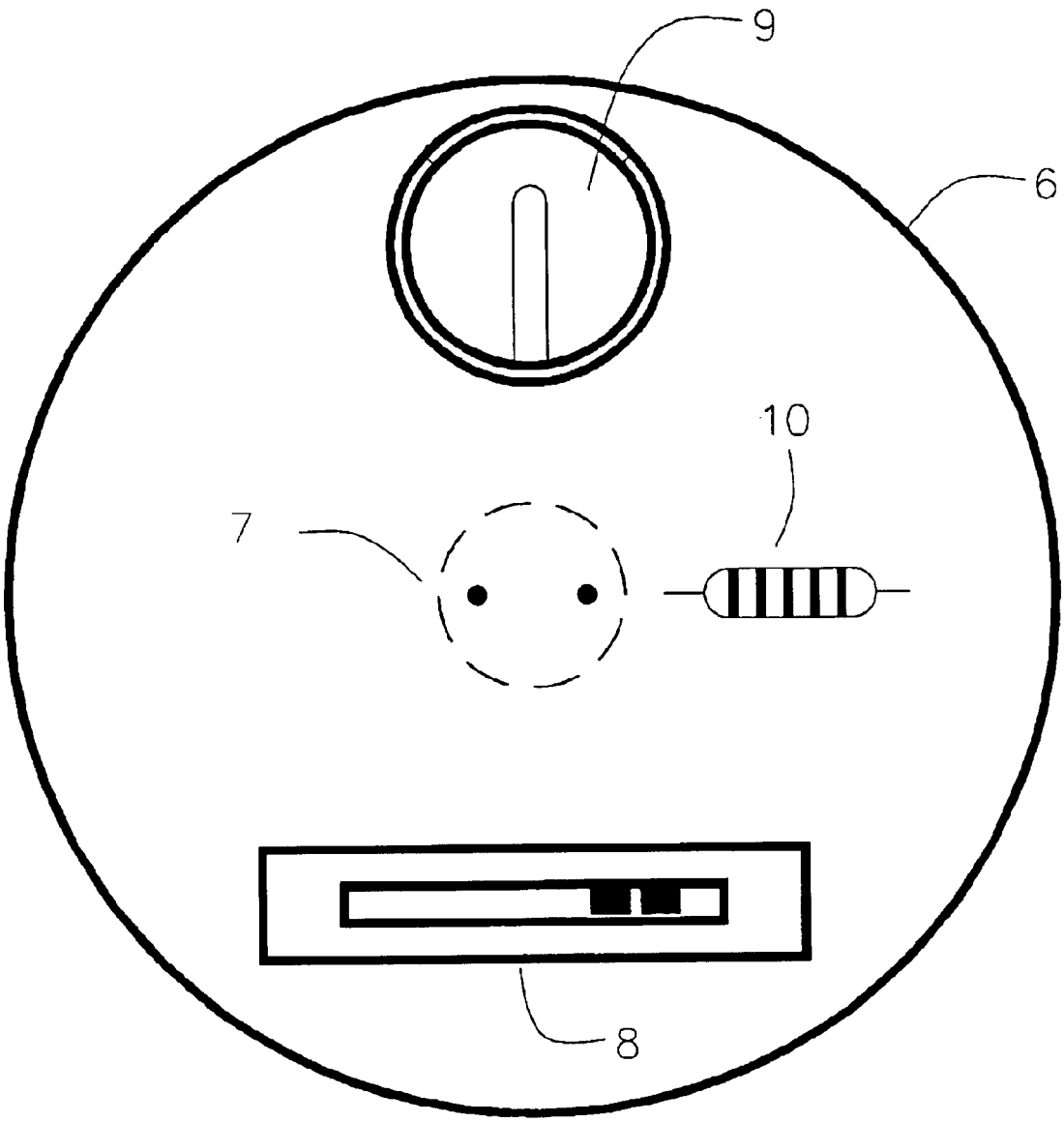
FIG. 3 is a physical schematic of the circuit board layout of the operating components located within FIG. 2.

In FIG. 3 the electronic components are displayed on the circuit board 6 where the battery holder 9 provides electric power to the switch 8 and, when turned to the on position, battery power is supplied through the resistor 10 and flows to the LED 7.

Figure 4:
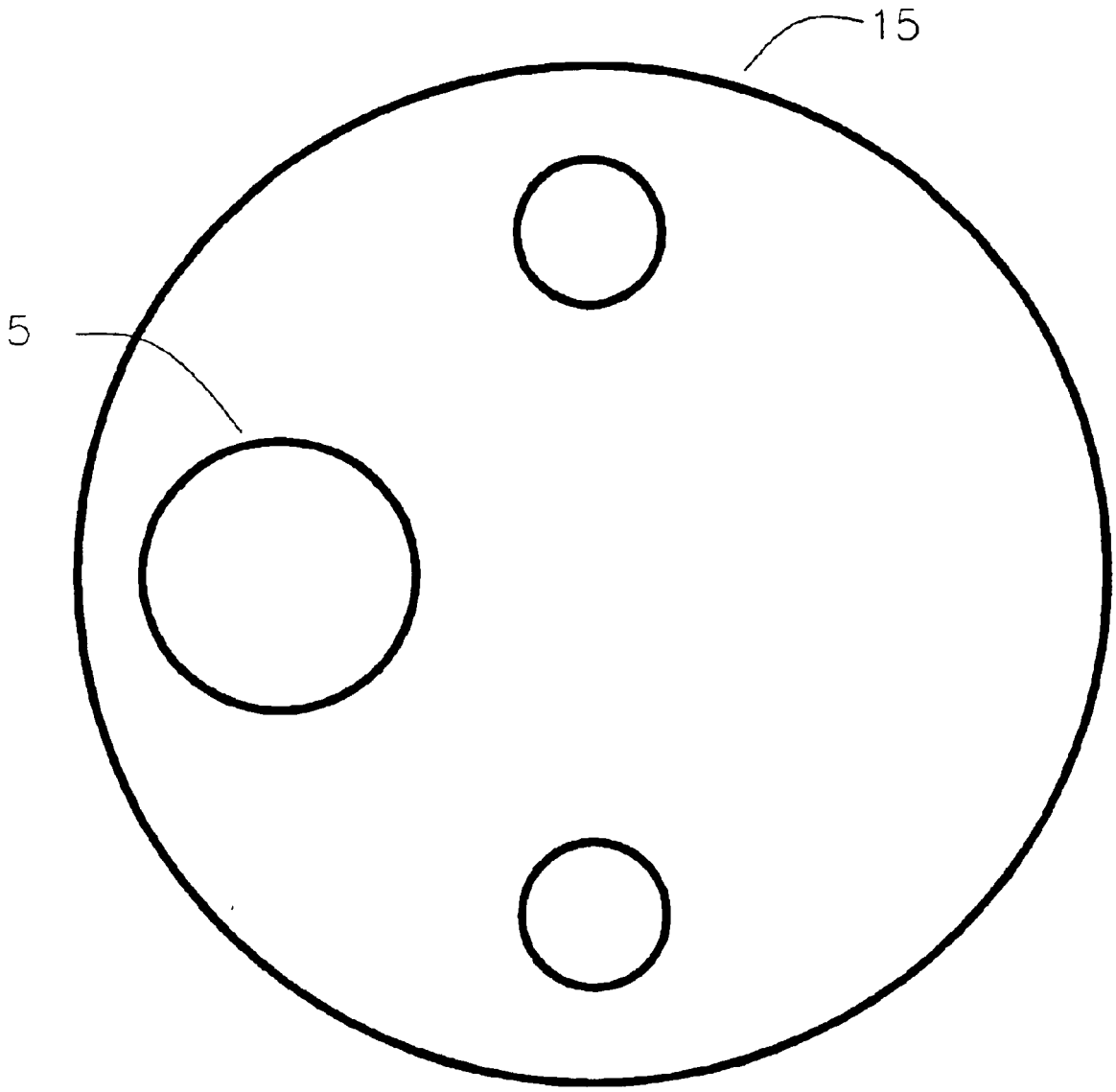
FIG. 4 is a plan view of the cover plate with holes punched out for screw access and switch access of FIG. 2.

The cover plate in FIG. 4 shows the opening provided to accommodate the two screws 17 with the cover plate in position. A hole 15 is provided so that the switch 8 can be readily accessible.

Figure 5:
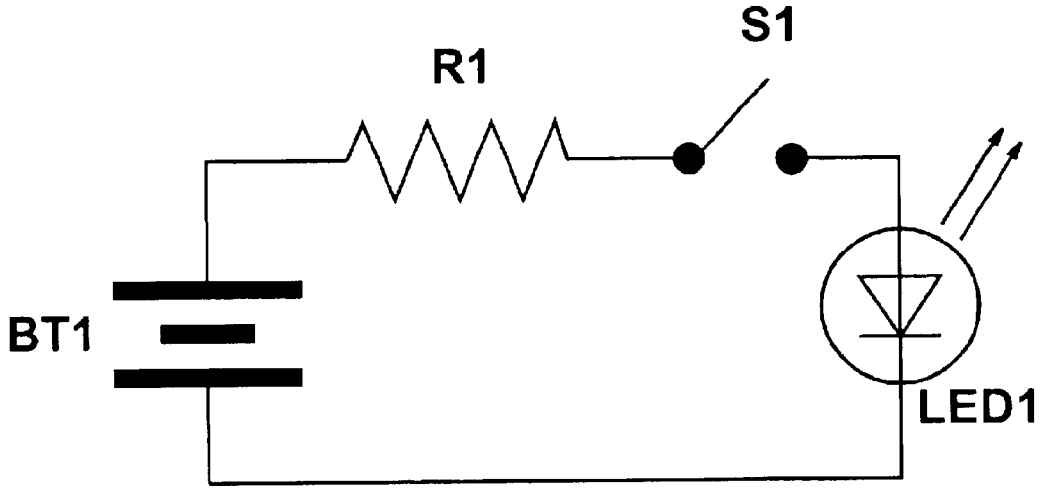
FIG. 5 is a schematic diagram of a control circuit of the apparatus of FIG. 3.

With particular reference to FIG. 5, the electric voltage is supplied by the primary battery BT1 which supplies DC power to LED 1 design valve.

Figure 6:
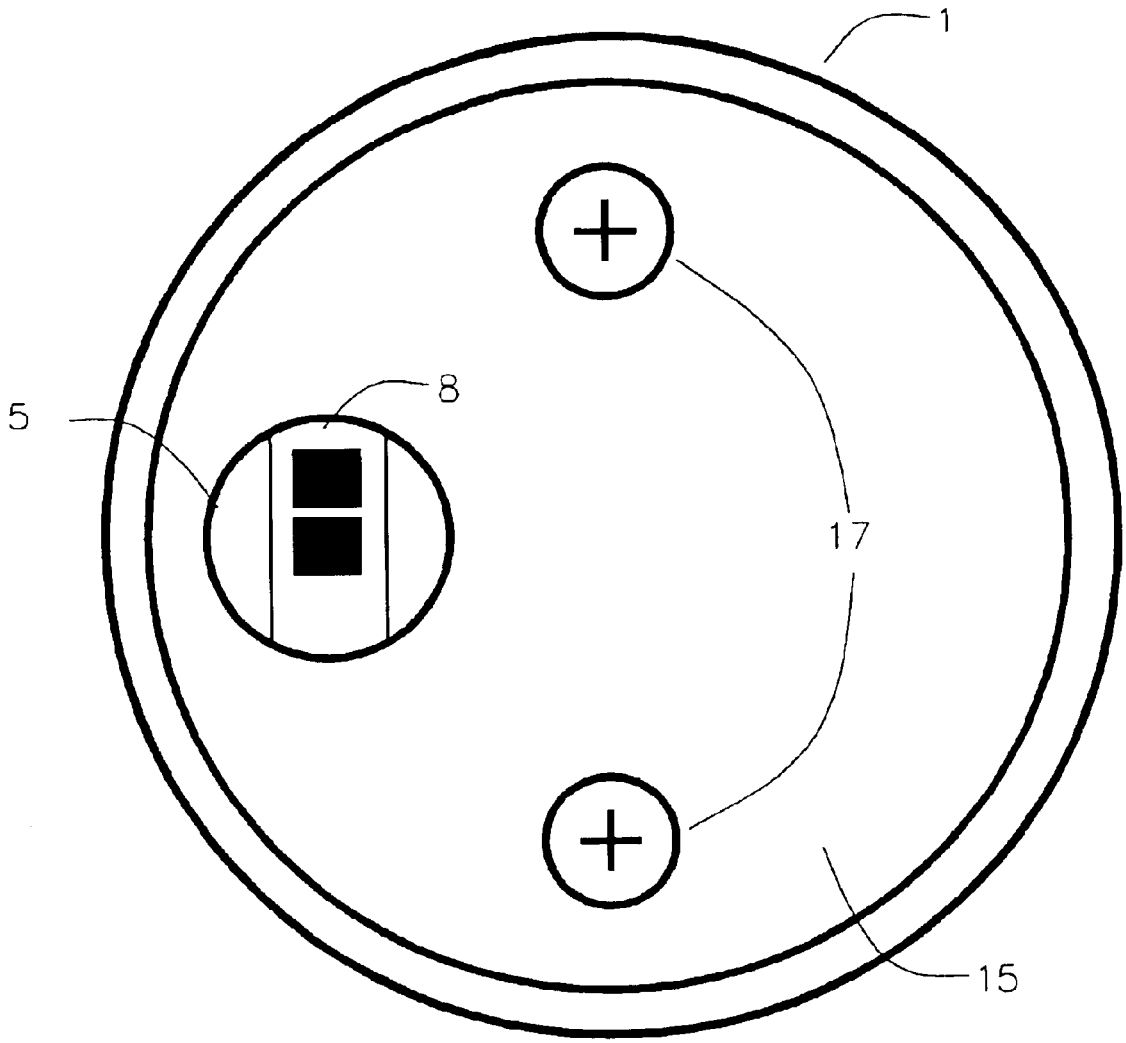
FIG. 6 is a plan view of the bottom cover plate with holding screws and switch access of FIG. 2.
Figure 7:
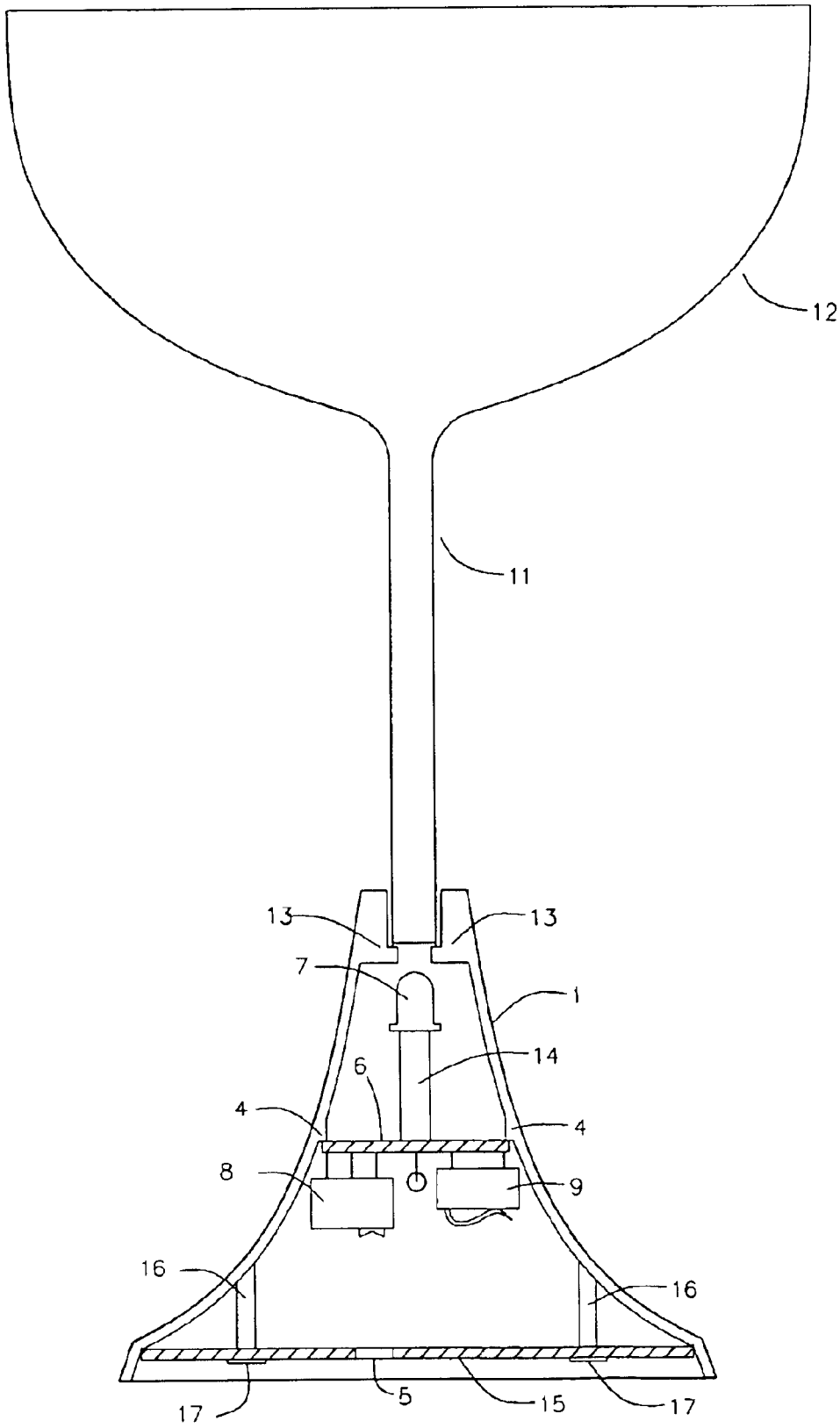
FIG. 7 is a front sectional elevation view of the apparatus of FIG. 1 and drinking glass with stem inserted within base of FIG. 2.

The under side of the base 1 in FIG. 6 is shown with the cover plate 15 installed and fastened to the base 1 by two screws 17.

FIG. 7 shows a complete sectional drawing with a glass having its stem inserted within the base 1 unit to rest on a smaller shelf 13. The shelf 13 is designed to prevent the glass stem 11 from recesssing further into the base 1 unit.

In order to change the battery in the battery holder 9 in FIGS. 3 and 2, the covering membrane plate 15 is secured to the screw standoffs 16 in FIG. 2 by the screws 17.

FIG. 4 shows the cover plate 15 with hole 5 to allow switch 8 to be turned on or off without taking cover plate 15 off. To change battery the screws 17 in FIG. 2 are extracted so that cover plate 15 can be removed.

What I claim as my invention is:

1. A wine glass base for holding a wine glass having a cup affixed to a first end of an elongated stem, said elongated stem comprising a free end opposite to the first end, comprising:

(a) a rigid hollow frame having a sufficiently large circumference at a lower portion of the frame permitting the frame to be self supporting, with an upper portion of the frame rising to a narrow top opening at the upper portion of the frame, the narrow top opening comprising a proximal end and a distal end, the proximal end comprising a shelf, the distal end receiving the free end and the shelf preventing the free end from recessing further into the narrow top opening, such that the elongated stem rests within the narrow top opening;

(b) a support means on an under side of the frame receiving an electric circuit board;

(c) the electric circuit board comprising a light source emitting a light beam aimed substantially through a longitudal axis of the elongated stem;

(d) a cover mounted horizontally at the lower portion of the frame concealing the circuit board; and (e) a battery supplying power to the circuit board disposed within the frame.

2. The wine glass base of claim 1 wherein the support means is a machined shelf.

3. The wine glass base of claim 2 wherein the light beam is emitted in various colors.

4. The wine glass base of claim 3 further comprising a holder for easy removal and replacement of the battery.

5. The wine glass base of claim 4 further comprising a switch that can be placed in an on or off position, wherein placing the switch in the on position causes the light source to be switched on, whereas placing the switch in the off position causes the light source to be switched off.

6. The wine glass base of claim 5 wherein the switch is readily accessible to an operator without removing the cover.

7. The wine glass base of claim 6 wherein the cover further comprises an opening exposing the switch for the on and off operation without removing the cover.

8. The wine glass base of claim 7 wherein the cover is easily removable for the battery replacement.

9. The wine glass base of claim 8 wherein the frame is constructed of a solid material colored to coordinate with a color of the light beam.

* * * * *